United States Patent [19]

Yanagawa et al.

[11] 4,155,545

[45] May 22, 1979

[54] SHEET FEED APPARATUS FOR ELECTROSTATIC COPYING MACHINE OR THE LIKE

[75] Inventors: Nobuyuki Yanagawa; Tsutomu Watanabe, both of Tokyo, Japan

[73] Assignee: Ricoh Co., Ltd., Tokyo, Japan

[21] Appl. No.: 857,663

[22] Filed: Dec. 5, 1977

[30] Foreign Application Priority Data

Dec. 14, 1976 [JP] Japan ..... 51/150646

[51] Int. Cl.[2] ..... B65H 5/02; B65H 5/14

[52] U.S. Cl. ..... 271/10; 271/274; 271/277; 355/3 SH

[58] Field of Search ..... 271/247, 246, 242, 277, 271/10, 245, 265, 273, 274, 206, 204, 12, 13, 16, 17; 355/3 TR, 3 SH

[56] References Cited

U.S. PATENT DOCUMENTS 3,345,065 10/1967 Shearer et al. ..... 271/206

3,637,203 1/1972 French ..... 271/246

3,924,848 12/1975 Murakami ..... 271/277 X

*Primary Examiner*—Bruce H. Stoner, Jr.

*Attorney, Agent, or Firm*—David G. Alexander

[57] ABSTRACT

A clamp which spans a pair of endless chains grips the leading edge of a sheet to convey the same into engagement with a photoconductive drum of an electrostatic copying machine or the like. A primary feed roller is driven through one rotation to feed the top sheet from a stack into the bite of the clamp. A cam follower actuated by a cam integral with the primary feed roller moves a release member into engagement with the clamp to open the same and further disengages secondary feed rollers between which the top sheet passes from the stack to the clamp. At the completion of rotation of the cam, the cam follower disengages the clamp to grip the leading edge of the sheet and engages the secondary feed rollers to feedingly grip the sheet. The secondary drive rollers are interconnected with the chains for integral driving movement after the sheet is gripped by the clamp and secondary feed rollers.

10 Claims, 10 Drawing Figures

SHEET FEED APPARATUS FOR ELECTROSTATIC COPYING MACHINE OR THE LIKE

BACKGROUND OF THE INVENTION

The present invention relates to a sheet feed apparatus for an electrostatic copying machine or the like.

In a known electrostatic copying machine a clamp is spanningly attached to a pair of endless chains. The clamp grips the leading edge of a copy sheet for conveyance of the same into engagement with a photoconductive drum for transfer of a toner image from the drum to the sheet. Subsequently, the chains convey the sheet through a fixing unit which thermally fixes the toner image to the sheet to provide a permanent reproduction of an original document corresponding to the toner image.

The top sheet of a stack is fed into the bite of the clamp by a primary feed roller which is typically driven for one rotation. The clamp is spring loaded so as to be normally closed and is held open by a stationary release member when in a standby position relative to the stack of sheets. In the standby position, the chains and clamp are stationary in preparation for receiving the sheet. After the sheet reaches the clamp, the chain is driven and the clamp disengages from the release member, thereby closing and gripping the sheet for conveyance by the chains.

In practice, the clamp is insufficient to reliably grip the sheet in opposition to attractive electrostatic forces between the sheet and photoconductive drum during toner image transfer. For this reason, a pair of secondary feed rollers are provided between the primary feed roller and the chains. The secondary feed rollers are disengaged by a cam mechanism driven in interconnection with the chains so that the sheet may pass therebetween from the stack to the clamp. As the chains are driven to convey the sheet, the cam mechanism engages the secondary feed rollers to grip the sheet and feed the same, thereby assisting the clamp and chains.

However, such an apparatus is subject to frequent malfunction unless various adjustments are made with precision. The release member must be adjusted so as to open the clamp by the precise required amount. The gap between the secondary feed rollers in the disengaged state must be small enough to reliably guide the sheet therebetween but large enough not to frictionally resist movement of the sheet.

The clamp often fails to grip the sheet since it progressively closes as movement of the chains is initiated and the clamp disengages from the release member. The clamp and secondary feed rollers must grip the sheet at precisely the same time. If the clamp closes before or after the secondary feed rollers grip and begin to feed the sheet, the clamp has a good possibility of missing the leading edge of the sheet. The feed rollers will feed the sheet into engagement with the drum in such a manner that the sheet may become wrapped around the drum and cause an overall jam of the copying machine. If the sheet is fed into the fixing unit and becomes jammed therein, a similar overall jam of the copying machine will result and the sheet may catch on fire due to overexposure to heat in the fixing unit. In summary, it will be seen that unless a prior art sheet feed apparatus of the type described above is subjected to frequent and precise adjustment, it will frequently malfunction and may even constitute a first hazzard.

SUMMARY OF THE INVENTION

The present invention overcomes the above described drawbacks of the prior art by providing a sheet feed apparatus in which the clamp and secondary feed rollers grip the sheet before the chains are moved for sheet conveyance. This unique and novel arrangement precludes the necessity of precise adjustment and ensures that the sheet will be securely gripped by the clamp.

It is an object of the present invention to provide a sheet feed apparatus for an electrostatic copying machine which reliably grips and feeds a sheet without the necessity of precise adjustment of the apparatus.

It is another object of the present invention to provide a generally improved sheet feed apparatus.

Other objects, together with the foregoing, are attained in the embodiments described in the following description and illustrated in the accompanying drawing.

DESCRIPTION OF THE PREFERRED EMBODIMENTS

While the sheet feed apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
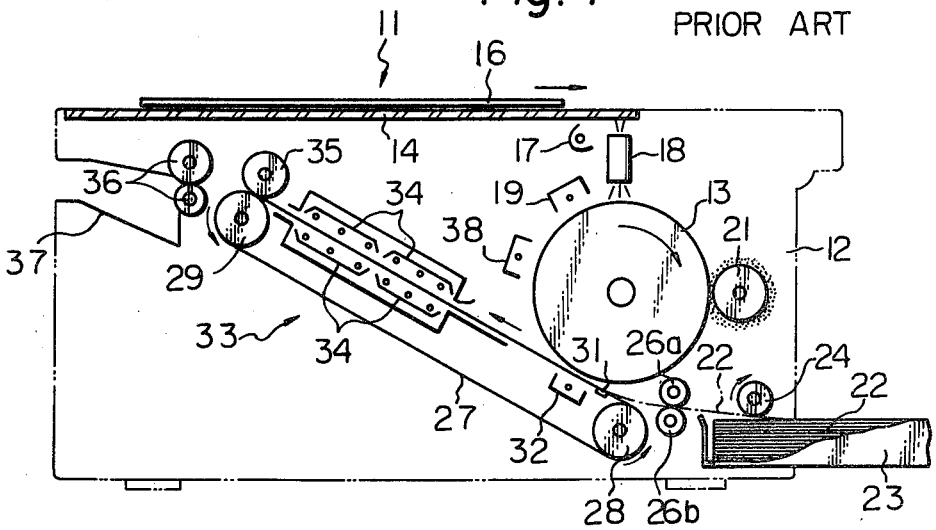
Fig. 1 PRIOR ART
FIG. 1 is an overall schematic view of a prior art sheet feed apparatus incorporated in an electrostatic copying machine.
Figure 2:
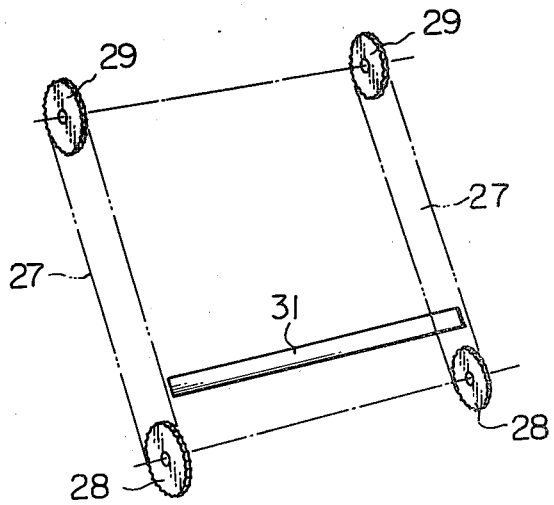
Fig. 2 PRIOR ART
FIG. 2 is an enlarged perspective view of a chain and clamp conveyor of the prior art apparatus.
Figure 3:
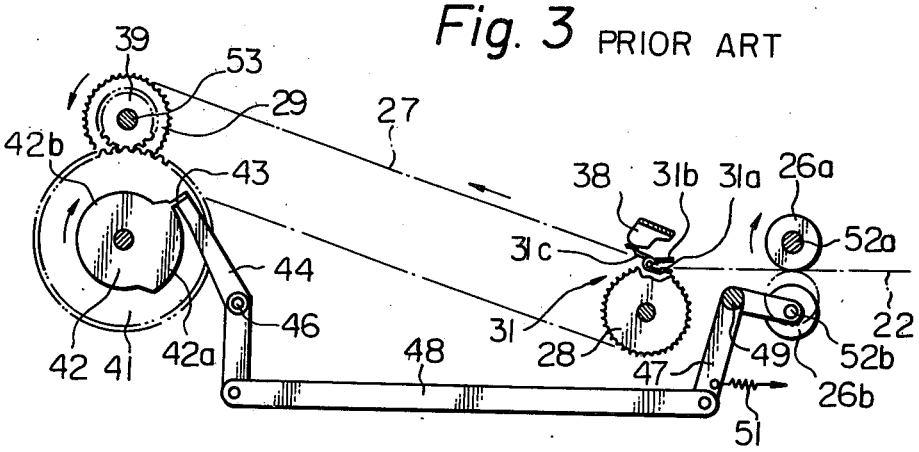
Fig. 3 PRIOR ART
FIG. 3 is detailed schematic view of the prior art sheet feed apparatus.

Referring now to FIGS. 1 to 3, a prior art electrostatic copying machine 11 comprises a housing 12 which encloses a photoconductive drum 13. The drum 13 is rotated clockwise at constant speed. A glass platen 14 supports an original document 16 for electrostatic reproduction face down and an illumination lamp 17 illuminates the document 16 from below through the platen 14. The platen 14 and document 16 are moved rightwardly at the same surface speed as the drum 13 for scanning. A focussing optical fiber array 18 disposed between the platen 14 and drum 13 focusses a light image of a linear portion of the document 16 (perpendicular to the scan direction) onto the drum 13. Prior to imaging, a charging unit 19 forms a uniform electrostatic charge on the drum 1. The light image causes localized photoconduction of the drum 13 to progressively form an electrostatic image thereon. A magnetic brush developing unit 21 applies a toner substance to the drum 13 to form a toner image thereon.

A plurality of copy sheets 22 are provided in a sheet holder or cassette 23 in the form of a stack. A primary feed roller 24 is urged downwardly against the top sheet 22 of the stack. As the leading edge of the toner image on the drum 13 approaches the roller 24, the roller 24 is energized for one rotation thereby feeding the top copy sheet 22 into the bite of secondary feed rollers 26*a* and 26*b*. A pair of endless chains 27 are trained around sprockets 28 and 29 and spanningly carry a clamp 31 therebetween. During a previous operation, the chains 27 were rotated to the illustrated position and stopped so that the clamp 31 is open and adjacent to the feed rollers 26*a* and 26*b*. The operation is timed so that the leading edge of the top copy sheet 22 is fed by the feed rollers 26*a* and 26*b* into the bite of the clamp 31 just as the leading edge of the toner image on the drum 13 reaches the clamp 31. The sprockets 28 and 29 are then driven for rotation and the clamp 31 closed. In this manner the chains 27 carry the copy sheet 22 in engagement with the surface of the drum 13 at the same surface speed thereas with the toner image on the drum 13 aligned with the copy sheet 22.

A transfer charger 32 is disposed below the drum 13 and applies an electrostatic charge to the copy sheet 22 of the same polarity as the electrostatic image on the drum 13. This causes the toner image to be transferred from the drum 13 to the copy sheet 22. The copy sheet 22 is then carried by the chain 27 through a thermal fixing unit 33 comprising heaters 34 which cause the toner substance to fuse to the copy sheet 22. As the clamp 31 passes over the sprocket 29 it is opened and the copy sheet 22 is fed into the bite of feed rollers 36 by a feed roller 35 which discharge the copy sheet 22 into a receiving tray 37 from which it is removed for use. After these operations are completed, the platen 14 is returned to its initial position in the leftward or return direction.

A discharge unit 38 dissipates any remaining electrostatic charge on the drum 13 after the toner transfer operation. During a second rotation of the drum 13 the developing unit 21 is utilized to remove any residual toner substance from the drum 13. Thus, the copying operation requires two rotations of the drum 13.

The mechanism for actuating the clamp 31 and secondary feed rollers 26*a* and 26*b* is illustrated in detail in FIG. 3. The clamp 31 comprises a lower member 31*a* which is fixed to the chains 27 and an upper member 31*b* which is rotatably connected to the lower member 31*a*. The bite (not designated) of the clamp 31 is defined between the member 31*a* and 31*b*. Although not illustrated, a torsion spring urges the upper member 31*b* clockwise as viewed in FIG. 3 toward the lower member 31*a* for gripping the leading edge of the sheet 22 between the members 31*a* and 31*b*. A release arm 31*c* integrally extends from the upper member 31*b*. The release arm 31*c* engages a stationary release member 38 in the initial or standby position illustrated in FIG. 3 so as to be rotated counterclockwise thereby, rotating the upper member 31*b* therewith to open the clamp 31.

A gear 39 integral with one of the sprockets 29 meshes with a gear 41 which is in turn integral with a cam 42. A cam follower 43 provided at an end of a bellcrank lever 44 engages the peripheral cam surface of the cam 42 which is provided with a large diameter portion 42*a* and a small diameter portion 42*b*. The bellcrank lever 44 is pivotal about a pin 46 and is pivotally connected at its other end to an end of another bellcrank lever 47 through a link 48. The bellcrank lever 47 is pivotal about a pin 49 and is urged counterclockwise by a tension spring 51. The spring 51 serves to maintain the cam follower 43 in engagement with the cam 42 through the bellcrank lever 47, link 48 and bellcrank lever 44.

Whereas the upper secondary feed roller 26*a* is driven for constant clockwise rotation through a shaft 52*a*, the lower secondary feed roller 26*b* is rotatably supported on a shaft 52*b* which is movable toward and away from the axis of the roller 26*a*. The shaft 52*b* is connected to the upper end of the bellcrank lever 47 so as to be moved between a sheet receiving position illustrated in solid line and a sheet feed position illustrated in phantom line.

The ratio between the gears 39 and 41 typically provides a 6:1 reduction. The ratio between the sprockets 29 and chains 27 also provides a 6:1 reduction. Thus, for each 6 rotations of the gear 39 and integral sprockets 29 the gear 41, cam 42 and chains 27 each make one rotation. Although not illustrated, a six-rotation clutch is provided between a motor and a rotary drive shaft 53 on which the gear 39 and sprockets 29 are fixed.

In operation, as the toner image on the drum 13 approaches the clamp 31, the primary feed roller 24 is driven for one rotation, feeding the top sheet 22 into the bite of the clamp 31. In the standby condition, the cam follower 43 engages the large diameter portion 42*a* of the cam 42 and the bellcrank lever 44 is rotated to its most clockwise position as illustrated. The link 48 is pulled leftwardly, urging the bellcrank lever 47 to rotate clockwise against the force of the spring 51 to move the roller 26*b* away from the roller 26*a*. Thus, a gap is defined between the rollers 26*a* and 26*b* through which the sheet 22 passes to the clamp 31.

In synchronization with the rotation of the drum 13, the six-rotation clutch is engaged to rotate the chains 27 counterclockwise and the cam 42 clockwise. The release arm 31*c* of the clamp 31 progressively disengages from the release member 38, thereby allowing the clamp 31 to close and grip the leading edge of the sheet 22 for conveyance to the drum 13. In addition, the cam 42 rotates so that the cam follower 43 drops onto the small diameter portion 42*b* of the cam 42. This causes the bellcrank lever 44 to rotate counterclockwise, moving the link 48 rightwardly. The bellcrank lever 47 rotates counterclockwise, moving the roller 26*b* into sheet gripping engagement with the sheet 22 and roller 26*a*. The roller 26*a* is driven at the same surface speed as the drum 13 and chains 27 so that the rollers 26*a* and 26*b* assist in feeding the sheet 22 to the drum 13.

In actual practice, it is very difficult to adjust the mechanism of FIG. 3 to operate properly as described. If the clamp 31 closes before the rollers 26*a* and 26*b* engage, the sheet 22 will most likely pull out of the bite of the clamp 31. This is because although a one-way clutch (not shown) is provided to the primary feed roller 24 allowing the same to rotate freely as the sheet 22 is pulled from the cassette 23 by the clamp 31, the frictional force of the roller 24 on the sheet 22 is generally greater than the gripping force of the clamp 31 thereon. The clamp 31 is insufficient to feed the sheet 22 without the assistance of the rollers 26*a* and 26*b*. Conversely, if the rollers 26*a* and 26*b* engage and feed the sheet 22 before the clamp 31 closes, the sheet 22 will buckle and pop out of the bite of the clamp 31. Frequent and precise adjustment of the mechanism of FIG. 3 is required for proper operation, thereby imposing disproportionate manufacturing and maintenance costs.

Figure 4:
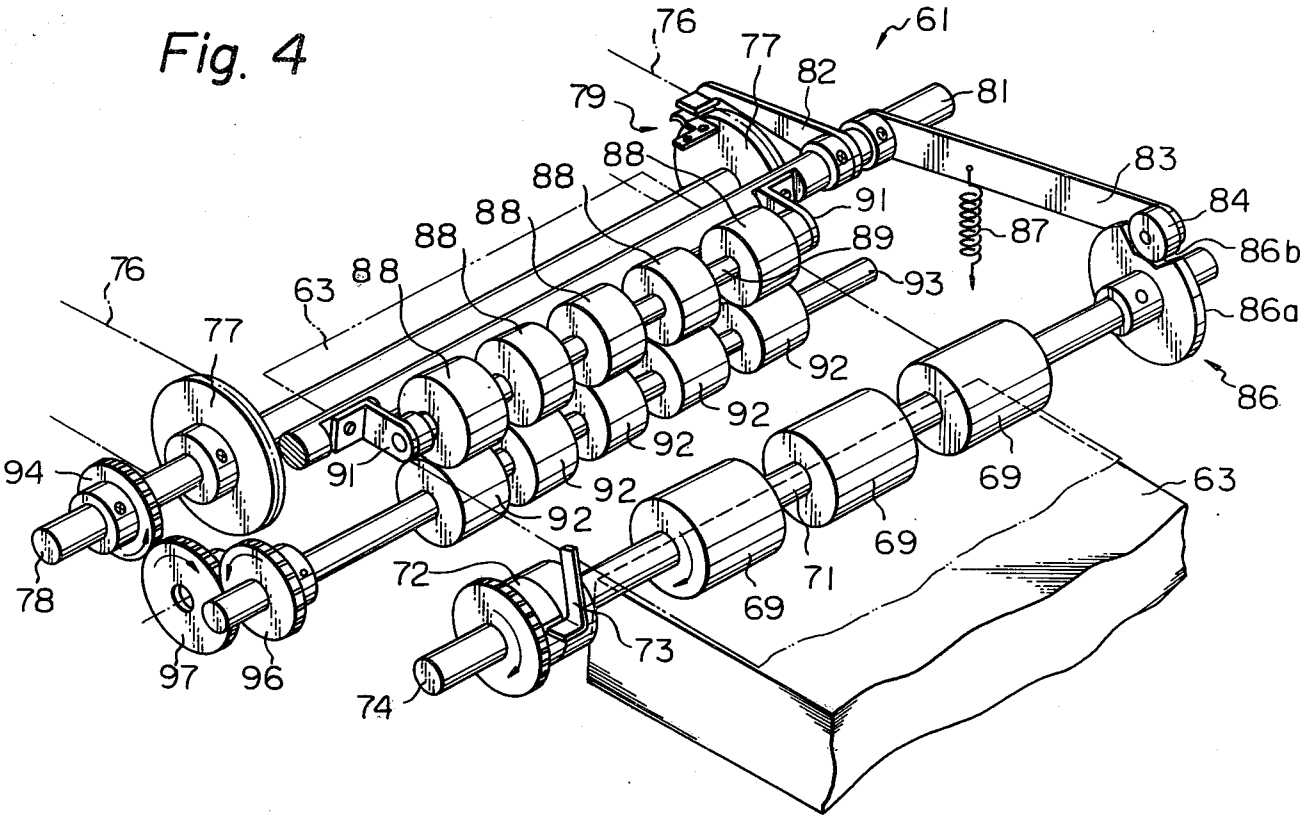
FIG. 4 is a fragmentary perspective view of a sheet feed apparatus embodying the present invention.
Figure 5:
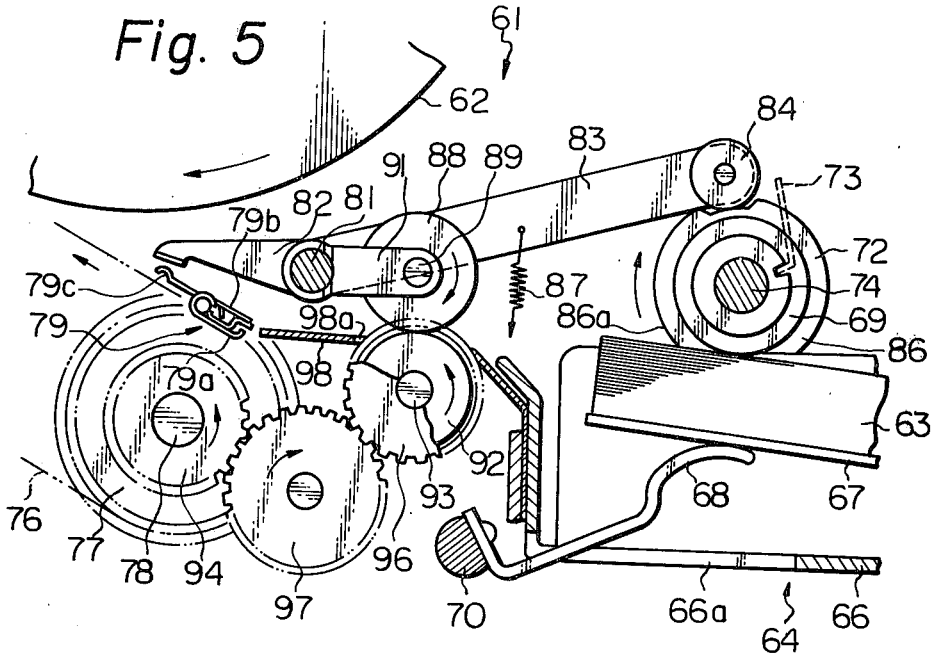
FIGS. 5 and 6 are detailed side elevations of the present sheet feed apparatus in sheet feeding and sheet receiving conditions respectively.
Figure 6:
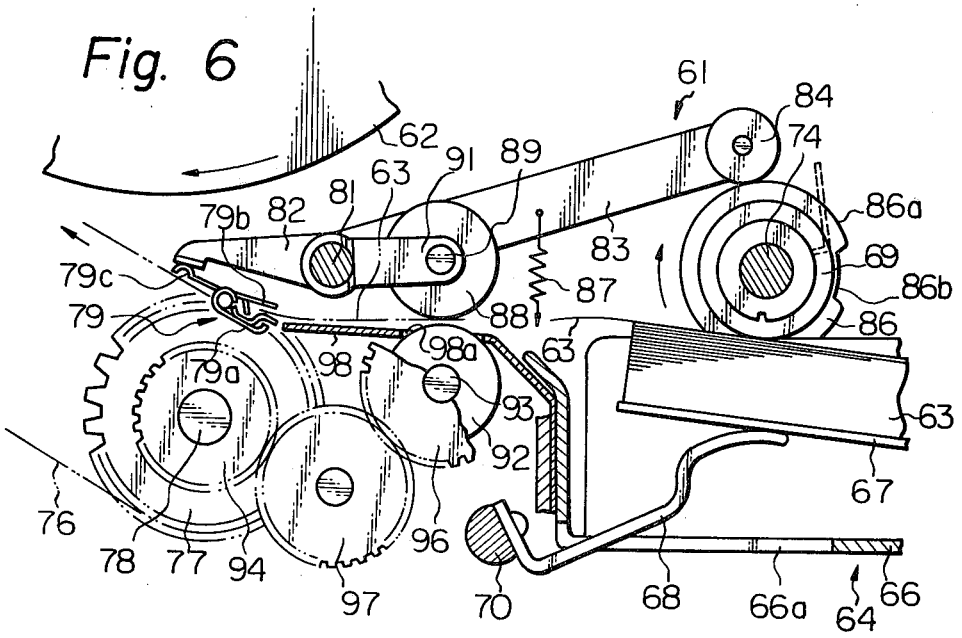

These drawbacks are completely overcome by a sheet feed apparatus 61 of the present invention which is illustrated in FIGS. 4 to 6, and is provided adjacent to a photoconductive drum 62 of an electrostatic copying machine, the other components of which correspond to those illustrated in FIG. 1 and are not illustrated in FIGS. 4 to 6. A stack of copy sheets 63 are provided in a sheet holder or cassette 64 which comprises an open box 66. A tiltable plate 67 is provided in the box 66 which supports the sheets 63. A lift arm 68 extends from a shaft 70 through an opening 66*a* formed through the bottom of the box 66. The shaft 70 is rotated counterclockwise so that the lift arm 68 pushes the plate 67 and sheets 63 upwardly so that the top sheet 63 firmly engages a plurality of primary feed rollers 69 provided on a shaft 71.

An input shaft 74 is driven clockwise at constant speed and is connected to the shaft 71 through a one-rotation clutch 72 which is actuated by an actuator arm 73.

A pair of chains 76 are trained around sprockets 77 and another pair of respective sprockets which are not illustrated but correspond to the sprockets 29 shown in FIGS. 1 to 3. The sprockets 77 are fixed to a rotary drive shaft 78 which is rotatable to drive the sprockets 77 and chains 76 counterclockwise for conveyance of the sheets 63 to the drum 62 for toner image transfer. A clamp 79 which is essentially similar to the clamp 31 described hereinabove spans the chains 76 and comprises a lower member 79*a* fixed to the chains 76, an upper member 79*b* rotatably connected to the lower member 79*a* and a release arm 79*c* integral with the member 79*b*. Although not illustrated, a spring urges the member 79*b* and release arm 79*c* clockwise toward engagement with the member 79*a*.

A shaft 81 is rotatably supported parallel to the shaft 71. A release arm 82 fixed to the shaft 81 is engageable with the release arm 79*c* of the clamp 79 to rotate the same counterclockwise to open the clamp 79 when the shaft 81 and arm 82 rotated counterclockwise, as illustrated in FIG. 6. An arm 83 is also fixed to the shaft 81 and carries a cam follower in the form of a roller 84 at the end thereof. The arms 82 and 83 in combination constitute a rocker arm (no numeral), which is rockable about the shaft 81. The roller 84 engages the periphery of a cam 86 fixed to the shaft 71 which is formed with a large diameter portion 86*a* and a small diameter portion or cutout 86*b*. A tension spring 87 urges the arm 83 clockwise, maintaining the roller 84 in engagement with the cam 86.

A plurality of secondary driven feed rollers 88 are rotatably mounted on a shaft 89 which is fixed to the shaft 81 by brackets 91. A plurality of conjugate secondary drive feed rollers 92 are fixed to a shaft 93 which is rotatable about a fixed axis. Gears 94 and 96 fixed to the shafts 78 and 93 respectively have the same diameter and are intermeshed through an idler gear 97. Thus, rotation of the shaft 78 and thereby the chains 76 causes rotation of the rollers 92 in the same counterclockwise direction and at the same surface speed as the drum 62.

FIG. 5 illustrates a sheet feed condition of the apparatus 61. The actuator arm 73 engages the clutch 72 to prevent rotation of the shaft 71, rollers 69 and cam 86. In this position, the roller 84 engages the cutout 86*b* of the cam 86, and the shaft 81 and arms 82 and 83 are rotated to their most clockwise positions by the spring 87. The rollers 88 are moved into engagement with the rollers 92 for driving rotation therewith. The release arm 82 disengages from the release arm 79*c* of the clamp 79, thereby allowing the clamp 79 to close.

As the toner image on the drum 62 approaches the clamp 79, the actuator arm 73 is momentarily disengaged from the clutch 72 and allowing the shaft 71 and primary feed rollers 69 to rotate clockwise by one rotation. The diameter of the rollers 69 is selected so that the top sheet 63 is fed into the bite of the clamp 79 by one rotation of the rollers 69.

Rotation of the shaft 71 causes the cam 86 to rotate such that the roller 84 rides onto the large diameter portion 86*a* of the cam 86. This occurs just as the rollers 69 begin to feed the sheet 63, and causes the arms 82 and 83 in addition to the shaft 81 to rotate counterclockwise to the position of FIG. 6, or to a sheet receiving position. The release arm 82 engages the release arm 79*c* of the clamp 79 to open the clamp 79. The rollers 88 are moved away from the rollers 92 to provide a gap therebetween. The top sheet 63 is fed between the rollers 88 and 92 over a guide plate 98 until the leading edge of the sheet 63 enters the bite of the clamp 79. Openings 98*a* are formed through the guide plate 98 through which the rollers 92 upwardly protrude. Upon completion of one rotation of the rollers 69 the roller 84 again drops into the cutout 86*b* of the cam 86 and the apparatus 61 returns to the position of FIG. 5. However, in this case the leading edge of the sheet 63 is clamped in the clamp 79 and the feed rollers 88 and 92 feedingly engage with or grip the sheet 63 therebetween.

After the sheet 63 is securely gripped by the clamp 79 and rollers 88 and 92, the shaft 78 is rotated to drive the chains 76 and rollers 92 which in combination feed the sheet 63 to the drum 62 for toner image transfer. The clutch 72 is provided with a one-way function and allows free rotation of the rollers 69 by the sheet 63.

In summary, it will be seen that upon one rotation of the rollers 69 the top sheet 63 is fed into the bite of the clamp 79 between the rollers 88 and 92. At the termination of said rotation the clamp 79 is closed and the rollers 88 and 92 moved together to grip the sheet 63. The chains 76 and rollers 92 are maintained stationary until the clamp 79 and rollers 88 and 92 securely engage the sheet 63. The chains 76 and rollers 92 are integrally driven to feed the sheet 63 only after the sheet 63 is securely gripped.

The present apparatus 61 is advantageous over the prior art in that proper gripping of the sheet 63 by the clamp 79 is ensured. Critical adjustments are unnecessary since the clamp 79 is stationary at the time it clamps the sheet 63 and furthermore the rollers 92 are not driven at the time the clamp 79 clamps the sheet 63. In other words, the clamp 79 and rollers 92 are maintained stationary until the sheet 63 is delivered into the bite of the clamp 79 by the feed rollers 69, and then engaged. Sheet feed is effected only after the sheet 63 is properly gripped.

Figure 7:
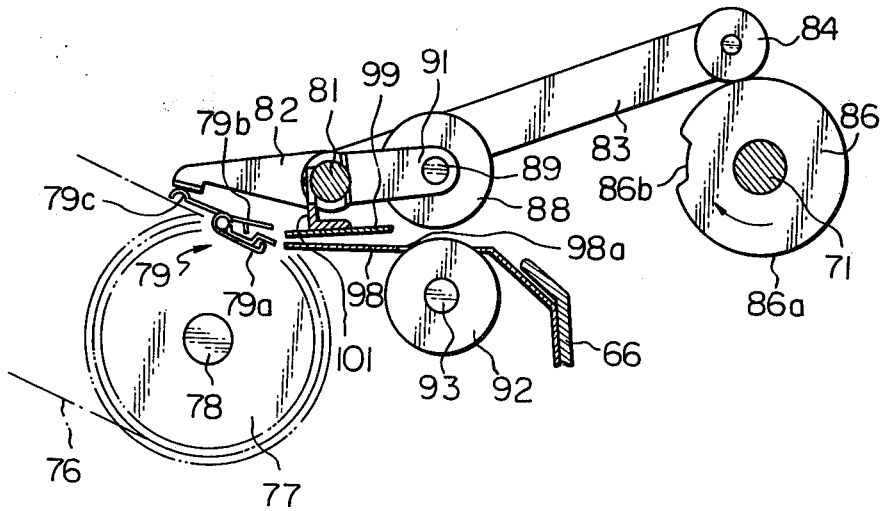
FIG. 7 is a fragmentary side elevation of a modified sheet feed apparatus of the invention.
Figure 8:
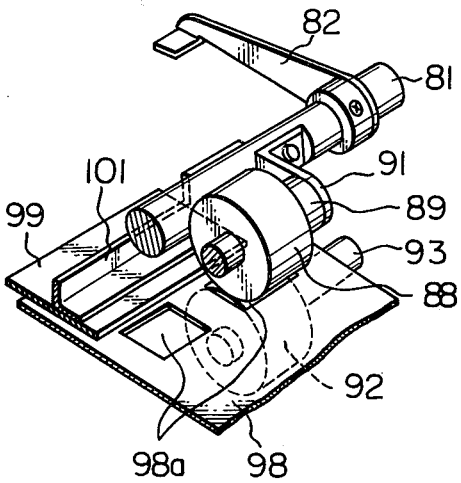
FIG. 8 is a fragmentary perspective view of the modification of FIG. 7.

FIGS. 7 and 8 illustrate a modification of the sheet feed apparatus 61, in which like elements are designated by the same reference numerals. FIGS. 7 and 8 illustrate the addition of an upper guide plate 99 which is fixed to the shaft 81 by a bracket 101. When in the sheet receiving position, the leading edge (right edge) of the plate 99 is moved away from the guide plate 98 and the trailing edge (left edge) of the plate 99 is moved toward the guide plate 98. This creates a tapering gap defined between the plates 98 and 99 which aids in guiding the leading edge of the sheet 63 into the clamp 79.

Figure 9:
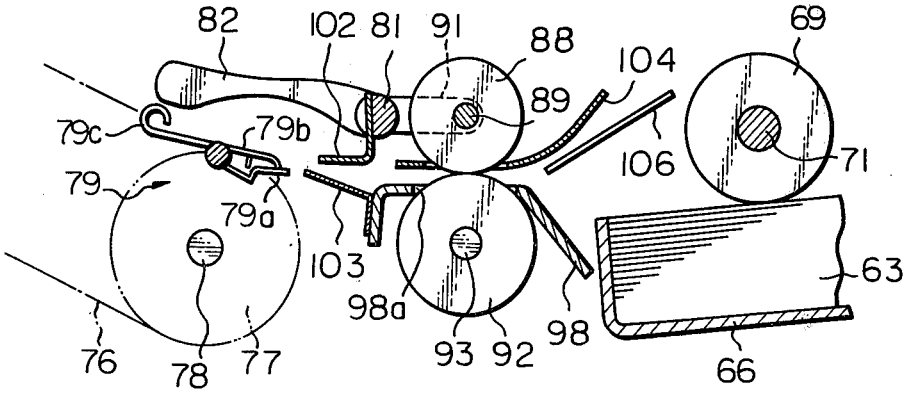
FIGS. 9 and 10 fragmentary side elevations of another modification of the present sheet feed apparatus in sheet feed and sheet receiving conditions respectively.
Figure 10:
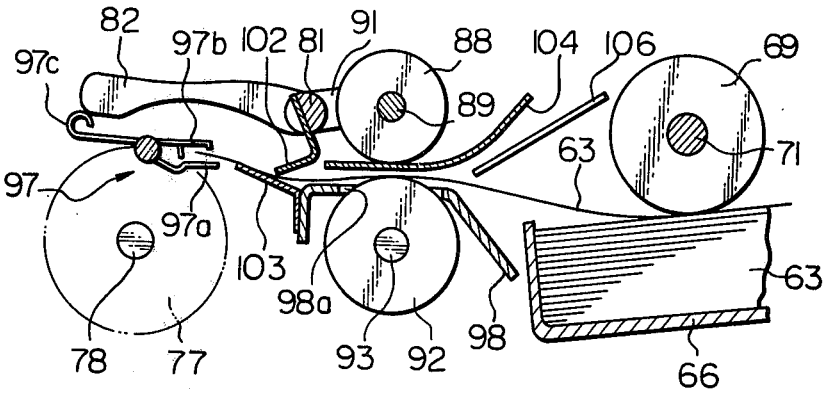

FIGS. 9 and 10 illustrate another modification of the apparatus 61 which features a fixed lower guide plate 103 constituting an extension of the guide plate 98 and an upper guide plate 102 fixed to the shaft 81. In the sheet receiving position illustrated in FIG. 10, the upper guide plate 102 is moved toward the lower guide plate 103 to form a narrow gap through which the sheet 63 must pass. This ensures accurate guidance of the sheet 63 into the bite of the clamp 79. FIG. 9 illustrates the sheet feed position in which the guide plate 102 is moved away from the guide plate 103. The guide plates 99, 102 and 103 may be made of metal, plastic or the like. Also shown are auxiliary guide plates 104 and 106.

Various modifications will become possible for those skilled in the art after receiving the teachings of the present disclosure without departing from the scope thereof.

What is claimed is:

1. A sheet feed apparatus comprising:

a sheet holder for holding a stack of sheets;

a conveyor;

a normally closed sheet clamp attached to the conveyor for integral movement therewith;

a primary feed roller provided above the sheet holder for feeding a top sheet from the stack into a bite of the clamp;

a secondary drive feed roller provided between the primary feed roller and the conveyor;

a secondary driven feed roller provided conjugate to the secondary drive feed roller;

a release member engageable with the clamp to open the clamp; and actuator means for integrally controlling the release member and secondary feed rollers, the actuator means moving the release member into engagement with the clamp to open the clamp and moving the secondary feed rollers out of engagement with each other to allow the primary feed roller to feed the top sheet into the bite of the clamp between the secondary feed rollers, and subsequently, moving the release member out of engagement with the clamp to allow the clamp to close and grip the top sheet and moving the secondary feed rollers into gripping engagement with the top sheet for conveyance of the top sheet by the conveyor and secondary feed rollers.

2. An apparatus as in claim 1, in which the conveyor and secondary drive feed roller are interconnected for integral driving movement.

3. An apparatus as in claim 1, in which the secondary drive feed roller is rotatable about a fixed axis and the secondary driven feed roller is movable toward and away from the axis of the secondary drive feed roller.

4. An apparatus as in claim 1, in which a diameter of the primary feed roller is selected so that the top sheet is fed into the bite of the clamp by one rotation of the primary feed roller.

5. An apparatus as in claim 4, in which the actuator means comprises a one rotation clutch provided to the primary feed roller, a cam attached to the primary feed roller for integral rotation therewith and a cam follower actuated by the cam for controlling the release member and secondary feed rollers.

6. An apparatus as in claim 5, in which the actuator means comprises a rocker lever, the release member and the cam follower being integrally attached to the rocker lever.

7. An apparatus as in claim 6, in which the secondary driven roller is rotatably supported by the rocker lever for movement toward and away from the secondary drive roller upon rocking movement of the rocker lever caused by rotation of the cam.

8. An apparatus as in claim 7, further comprising a movable guide member which is integrally attached to the rocker lever and a fixed guide member provided conjugate to the movable guide member, the movable guide member being so configured as to be moved toward the fixed guide member by the rocker lever when the release member engages with the clamp for guiding the top sheet between the guide members.

9. An apparatus as in claim 7, further comprising a movable guide member which is integrally attached to the rocker lever and a fixed guide member provided conjugate to the movable guide member, the movable guide member being so configured that a leading edge thereof is moved away from the fixed guide member and a trailing edge thereof is moved toward the fixed guide member by the rocker lever when the release member engages with the clamp for guiding the top sheet between the guide members.

10. An apparatus as in claim 1, in which the conveyor comprises a pair of endless chains, the clamp spanning the chains.

* * * * *